United States Patent [19]

Braun et al.

[11] 4,320,731

[45] Mar. 23, 1982

[54] CARBURETOR AIR BLEED CONTROL SYSTEM

[75] Inventors: Paul E. Braun, Bloomfield Hills; Joseph F. Lopiccola, Troy; Richard J. Freismuth, Mount Clemens, all of Mich.

[73] Assignee: Ford Motor Company, Dearborn, Mich.

[21] Appl. No.: 109,731

[22] Filed: Jan. 4, 1980

[51] Int. Cl.[3] ..... F02M 7/00

[52] U.S. Cl. ..... 123/440; 123/437; 261/121 B

[58] Field of Search ..... 123/437, 438, 440, 489; 261/121 B

[56] References Cited

U.S. PATENT DOCUMENTS

| | | | |
|---|---|---|---|
| 3,841,283 | 10/1974 | Wood | 261/DIG. 74 |
| 3,857,908 | 12/1974 | Brown et al. | 261/39 A |
| 3,899,551 | 8/1975 | Korte | 261/39 A |
| 3,925,521 | 12/1975 | Otani | 261/121 B |
| 4,052,968 | 10/1977 | Hattori et al. . | |
| 4,065,920 | 1/1978 | Minami et al. . | |
| 4,086,890 | 5/1978 | Minami et al. | 123/440 |
| 4,135,482 | 1/1979 | Bier et al. | 261/69 R |
| 4,136,645 | 1/1979 | Ito et al. | 261/DIG. 74 |
| 4,190,028 | 2/1980 | Carlson et al. | 261/121 B |
| 4,224,908 | 9/1980 | Bier et al. | 261/121 B |

FOREIGN PATENT DOCUMENTS

| | | |
|---|---|---|
| 2529663 | 1/1977 | Fed. Rep. of Germany . |
| 1445849 | 8/1976 | United Kingdom . |

OTHER PUBLICATIONS

"A Feedback Controlled Carburetion System Using Air Bleeds" by T. R. Gantzert et al., SAE, Feb. 28–Mar. 4, 1977.

*Primary Examiner*—P. S. Lall

*Attorney, Agent, or Firm*—Robert E. McCollum; Clifford L. Sadler

[57] ABSTRACT

A free standing air bleed control module is connected to an automotive downdraft type carburetor only by tubing so that it can be located in any convenient position in the engine compartment and yet provide a complete air bleed function to the carburetor fuel lines without a new casting for the carburetor; the module containing a bleed air metering valve movable by a servo to control the flow of bleed air into the fuel lines of the carburetor, the servo being controlled by a computer sensitive to engine operating conditions to schedule the bleed of air at the desired time.

1 Claim, 2 Drawing Figures

CARBURETOR AIR BLEED CONTROL SYSTEM

Figure 1:
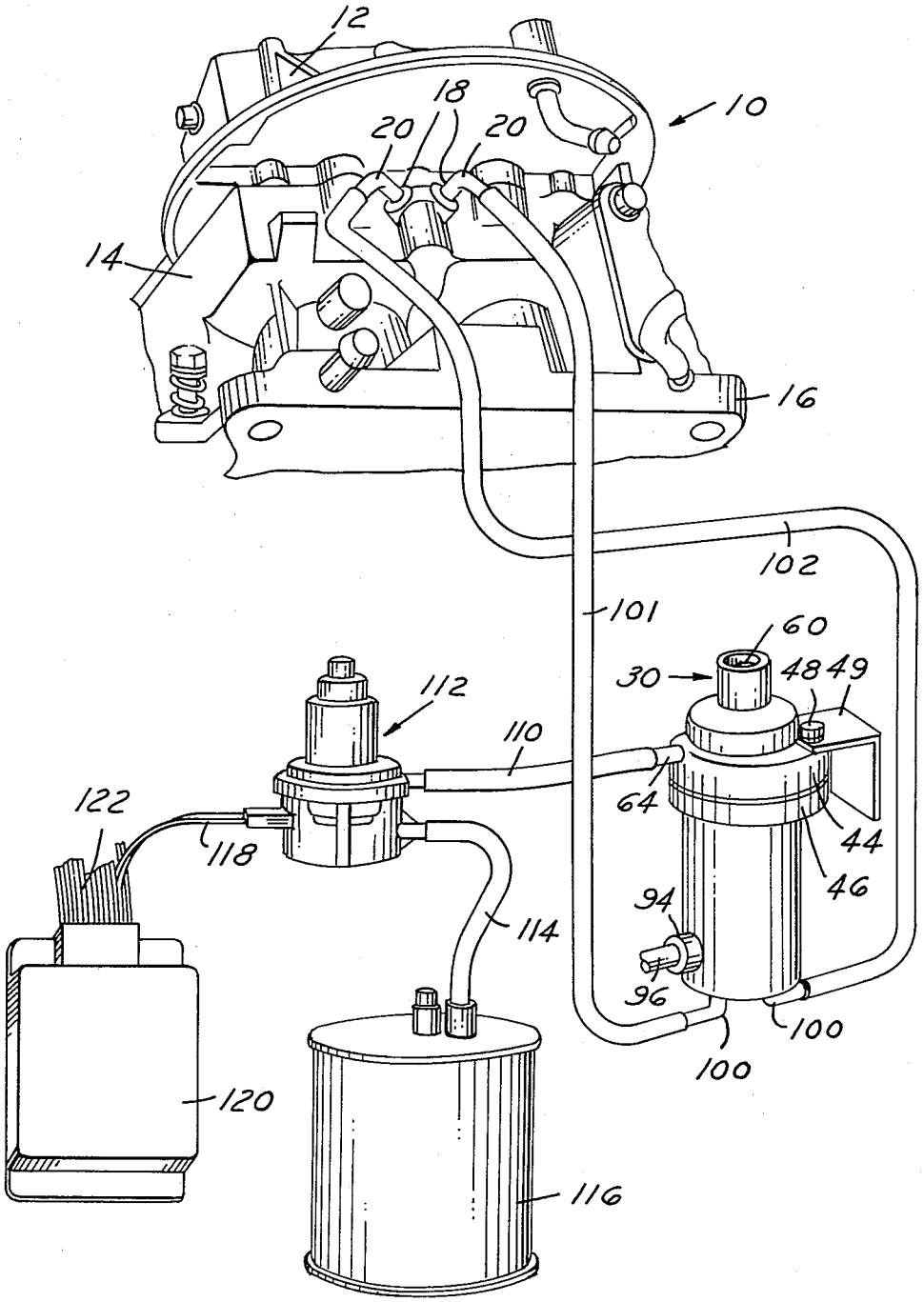

This invention relates in general to an automotive type carburetor. More particularly, it relates to a free-standing air bleed control module for use with the carburetor that can be mounted in any convenient location in the engine compartment of a motor vehicle.

Many commercial motor vehicle type carburetors are provided with air bleed systems that at selected times will bleed air into the fuel lines of a carburetor to control fuel flow. In substantially all cases, the carburetor structure per se must be modified by a new casting or other change to accommodate the control units for accomplishing the air bleed control desired. For example, U.S. Pat. Nos. 3,841,283, 4,052,968, 4,065,920, 4,135,482, 4,136,645, British Pat. No. 1,445,849, and German Pat. No. 2,529,663, all show carburetors having integrally mounted air bleed control units that are electrically actuated to move a valve to control the bleed of air into a fuel line. In all cases, a new carburetor casting is required, which is expensive and does not permit a retrofit of the conventional carburetor. U.S. Pat. Nos. 3,899,551 and 3,857,908 both do show a separate module for controlling the bleed of air into the fuel systems of a carburetor but they are operatively responsive only to barometric and temperature changes.

This invention relates to a carburetor air bleed control module that can provide a feedback control for a carburetor without modifying the carburetor structure per se other than to connect air lines to the air bleed holes of the carburetor, and possibly a vacuum line from the carburetor. In other words, the invention provides a retrofit of a carburetor with an air bleed device that does not require other than minor modifications of the carburetor control lines, and one that is readily adaptable to any commercial carburetor presently available.

It is a primary object of the invention, therefore, to provide a carburetor air bleed control system that includes a free standing or stand alone air bleed control module that is divorced from the carburetor structure so as to be mountable in any convenient position in a motor vehicle engine compartment.

It is another object of the invention to provide a control module of the type described above that includes a metering valve that will accurately meter the flow of air into the carburetor in response to predetermined signals from an electronic control unit that is connected to the engine so as to be sensitive to, predetermined engine operating conditions.

It is another object of the invention to provide a control module of the type described that includes an actuator connected to the bleed air metering valve that is controlled by an output signal from the electronic control unit to vary the position of the metering valve.

It is a still further object of the invention to provide a stand alone control module of the type described having a vacuum servo operatively connected to at least one bleed air metering valve by means of a guide plate and force transmitter that is coaxially located in the housing to transmit the movement of the servo means to the metering valve.

Figure 2:
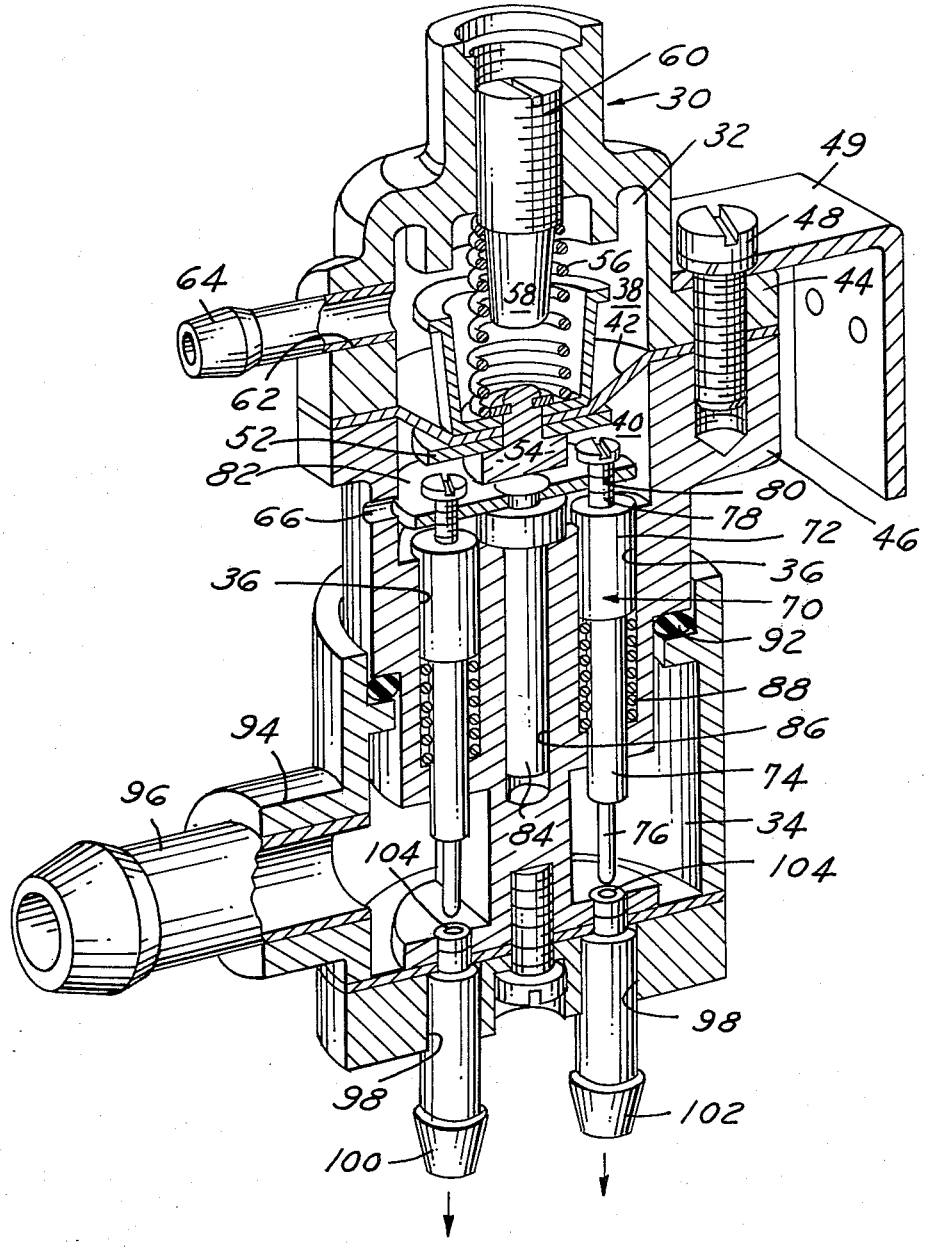

Other objects, features and advantages of the invention will become more apparent upon reference to the succeeding detailed description thereof, and to the drawings illustrating the preferred embodiment thereof, wherein, FIG. 1 is a schematic representation of a carburetor control system embodying the invention, with parts broken away and in sections, and;

FIG. 2 is an enlargement of a detail of the control module illustrated in FIG. 1.

FIG. 1 shows in an elevational view a portion of a known type of downdraft carburetor 10. It has the usual air horn air inlet section 12, a main body portion 14, and an integral throttle mounting flange portion 16. Although not shown, it would contain the usual induction passage and main and idle fuel flow passages connected to the induction passage. Further details of construction and operation of the carburetor per se are not given since they are known and believed to be unnecessary for an understanding of this invention. Suffice to say that the carburetor contains the usual air bleeds, which inlets in this case, are indicated at 18, into which are mounted a pair of connectors 20.

As stated previously, the invention is concerned with an air bleed control module that can be mounted separately of the carburetor so as not to require a major modification of the carburetor and yet provide a controllable air bleed function to the carburetor. Referring more specifically to the drawing, and to FIG. 2, the control module in this case includes an outer two piece housing 30 having an upper cavity 32, a lower cavity 34, and a plurality of parallel or coaxial bores 36. The upper cavity 32 is partitioned into a vacuum chamber 38 and an air chamber 40 by an annular flexible diaphragm member 42. The latter is edge mounted as shown between two portions 44 and 46 of the housing joined by bolt means 48 as shown. The bolt means also supports a mounting bracket 49. Secured to a central portion of the diaphragm 42 is a cup-shaped spring retainer 50 that connects the diaphragm to a second retainer 52 by a rivet 54. The diaphragm is biased downwardly by a spring 56 seated at its upper end against and surrounding the end 58 of an adjustable stop screw 60. The chamber 38 is connected to a source of varying vacuum through an inlet 62 containing an adapter 64. The air chamber 40 is connected to air essentially at atmospheric pressure through a bleed hole 66.

Each of the parallel bores 36 contains a needle type metering valve 70 of stepped diameter construction. It has an upper land or barrel 72, an intermediate barrel 74, and a needle-like valve element 76. Projecting from the upper land 72 is a screw 78 that is threadedly received in a hole 80 in a combination guide and force transmitting plate 82. The holes 80 in this case are equally circumferentially spaced from one another and equally radially spaced from the axis of the plate 82. Plate 82 is riveted to a central plunger 84 that is slidably received in an axial bore 86 in the housing. A spring 88 surrounds the middle barrel portion 74 of each metering valve and biases the valve upwardly as shown.

The lower cavity 34 is formed in a lower portion of the housing that is connected to the upper portion by means not shown with an O-ring 92 between. The housing portion defining the cavity has a clean air inlet 94 containing an adapter 96, and a number of clean air outlets 98 containing similar adapters 100. The outlets correspond in number to the number to the number of metering valves. It will be seen that the inlet 94 and outlets 98 are at right angles to one another, thus providing a flow of clean air throughout the chamber or cavity 34 for cleaning the same as well as the metering valve elements 76.

The air inlet 94 could in this case be connected to the clean air side of the carburetor air cleaner. One of the outlets 98 could conveniently be connected by tubing 100, for example, to the main fuel metering passage of the carburetor, not shown. The other outlet 98 could be connected by tubing 102 to the idle fuel passage of the carburetor, if desired.

The vacuum line adapter 64 in this case is connected by a tube 110 to an electrically operated vacuum controller indicated in general at 112. The controller might be of a known stepper motor type containing an on/off type valve electrically actuated so as to variable control the flow of vacuum to line 110 from a line 114 connected to a vacuum source 116. The controller 112 in this particular case would receive an input electrical signal from a line 118 connected to an electronic control unit indicated in general at 120. The electronic control unit also would be of known construction having a number of input signal connectors 122 that are adapted to be connected to various parts of the engine so as to be sensitive to various operating conditions of the engine. These signals in turn would be converted by the ECU unit at the appropriate time to an output signal to the vacuum controller 112. This would open the valve of the controller and permit a predetermined vacuum flow from the source 116 through the line 110 to actuate the diaphragm 42 of the servo mechanism of the control module. The duration of the actuation would be controlled by the ECU unit. Further details of operation and construction of the ECU unit and vacuum controller are not given since they are known and could, for example be such as is shown and fully described in U.S. Pat. No. 3,969,614. Suffice to say that the ECU unit would be sensitive to many changing engine conditions such as operating temperature levels, manifold vacuum level, engine speed, and other engine operating parameters to control the flow of vacuum to the module.

In operation, therefore, when a predetermined condition of engine operation occurs, such as, for example, a decelerating condition, the ECU unit may call for a bleed of air into, say, the fuel system of the carburetor. Accordingly, the vacuum controller 112 is energized to open the connection between the vacuum source 114 and the vacuum line 110 leading into chamber 38 of the control module. The diaphragm 42 then will be lifted against the force of spring 56, permitting the spring 88 acting against the metering valves and the air acting in air chamber 40 to move the guide plate and transmitter 82 upwardly, thus moving the metering valves 76 out of the discharge holes 104 in adapters 100. Thus, bleed air will flow into the carburetor air bleed passages 18, decreasing the fuel flow signals and therefore decreasing fuel flow in the desired manner. As soon as the ECU unit receives a feedback signal from the carburetor that a particular action has occurred, a signal will be sent to the vacuum controller to decrease or shut the valve opening, thus decreasing or completely shutting off the supply of vacuum to the control module. This again will permit the force of springs 56 and 88 in cooperation with the vacuum and air flow in chambers 38 and 40 to either maintain that position of the metering valves or to move the metering valves to change the bleed air flow, as the case may be.

From the foregoing, therefore, it will be seen that the invention provides a completely operative air bleed control module that is separated from the carburetor. Therefore, the invention can provide a feedback control in substantially all instances to existing carburetors not only without a reworking of the carburetor casting but essentially without a modification to the carburetor at all.

While the invention has been shown and described in its preferred embodiment, it will be clear to those skilled in the arts to which it pertains that many changes and modifications may be made thereto without departing from the scope of the invention. For example, it will be clear that the vacuum servo mechanism of the control module may be replaced by a solenoid actuated diaphragm so that the module could be actuated to move the metering valves directly in response to a signal from the ECU unit 120.

We claim:

1. A carburetor air bleed control system for use with an automotive type engine mounted carburetor having an intake manifold, and a plurality of fuel systems and air bleeds connected thereto for the bleed of air thereinto to control fuel flow into the carburetor, the system including a free standing air bleed control module, divorced from the carburetor for the separate mounting thereof at a selected location in the engine compartment of a vehicle in which the engine is installed, the module having a housing having a clean air inlet and a plurality of bleed air outlets adapted to be connected to a carburetor air bleed line, a plurality of metering valves variably movable into and out of the outlets to control flow of bleed air therethrough, spring means biasing the valves to a failsafe closed position blocking bleed air flow, and engine responsive movable actuating means connected to the metering valves as a function of changes in engine operating conditions, including an electronic control unit having a plurality of electrical inputs adapted to be connected by sensors to the engine for receiving input signals therefrom indicative of changing conditions of operation of the engine, the control unit having an output signal means connected to the metering valve actuating means for effecting the movement of the metering valves in response to a predetermined signal from the control unit, the housing having a cavity at one end, a flexible diaphragm extending across the cavity partitioning the cavity into a vacuum chamber and an air chamber on opposite sides, a variable level vacuum inlet in the housing connected to the vacuum chamber, the housing containing a bore slidably receiving therein the plurality of metering valves, a guide plate and force transmitter coaxially mounted with respect to the metering valves and connected thereto for moving the metering valves, the first mentioned spring means biasing the diaphragm into engagement with the guide plate to move the metering valves in cooperation with the air force, and second spring means biasing the metering valves to an open position first mentioned spring means, the housing having a central bore slidably mounting the guide plate, the guide plate having a plurality of circumferentially spaced, coaxially located holes each fixedly and adjustably receiving therein the upper end of a metering valve, the metering valves each being mounted for a sliding movement in a bore coaxial with the central bore.

* * * * *